United States Patent [19]

Ogura et al.

[11] Patent Number: 4,468,592

[45] Date of Patent: Aug. 28, 1984

[54] STROBO APPARATUS

[75] Inventors: Hisashi Ogura, Nara; Kazuo Tanaka, Neyagawa, both of Japan

[73] Assignee: West Electric Company, Ltd., Osaka, Japan

[21] Appl. No.: 448,440

[22] Filed: Dec. 10, 1982

[30] Foreign Application Priority Data

Dec. 11, 1981 [JP] Japan ..... 56-200466

[51] Int. Cl.[3] ..... H05B 41/32

[52] U.S. Cl. ..... 315/241 P; 315/225; 362/10

[58] Field of Search ..... 315/119, 225, 241 P; 354/145.1; 362/9, 10

[56] References Cited

U.S. PATENT DOCUMENTS 4,082,983 4/1978 Adams, Jr. ..... 315/241 P

*Primary Examiner*—Eugene R. LaRoche

*Attorney, Agent, or Firm*—Cushman, Darby & Cushman

[57] ABSTRACT

In a strobo apparatus comprising a power source part (A) containing a low voltage battery and a DC-DC converter circuit, a flashing part (B) containing a main capacitor and being separably connected with the power source part, and also has a detecting means for detecting the said separation of the flashing part. By utilizing the output of the detecting means, the operation of the DC-DC converter circuit is compulsorily stopped, accordingly, waste of battery is eliminated and unnecessary high insulation against useless high tension during the separation of two parts can be dispensed with.

3 Claims, 4 Drawing Figures

STROBO APPARATUS

BACKGROUND OF THE INVENTION

1. Field of the Invention

The present invention relates to a strobo apparatus which comprises a power source part and a flashing part, the two parts being separable.

2. Description of the Prior Art

A strobo apparatus, specially a large strobo apparatus, is composed of a power source part and a flashing part containing a main capacitor, the two parts being separable according to its using object.

In the above-mentioned apparatus, when a low voltage battery and a well known DC-DC converter circuit are used as the power source part, even though the power source part is separated from the flashing part containing the main capacitor, the DC-DC converter circuit is still maintained operating as far as a power source switch is closed. That is, although the load, namely, the main capacitor is detached from the power source part, the low voltage battery is supplying energy continuously, and of course the transformer of the DC-DC converter circuit produces high voltage continuously.

Therefore, not only the waste of energy of the power source part arises, but also another problem arises that, since high voltage is impressed on the oscillation transistor of the DC-DC converter circuit due to non-load state of the transformer. Therefore, we must select such transistor that has a high breakdown against such high voltage; that is versatility of design of the said transistor is narrow, and the cost of the said transistor is very expensive.

Furthermore, at the separation part, the output terminals of the power source circuit are fed with a high alternative voltage, therefore we must beware of the insulation of the said output terminal not to make dangerous electric shock.

SUMMARY OF THE INVENTION

The present invention can offer a strobo apparatus which can solve the above-mentioned problem. That is, it is the object of the present invention to provide a strobo apparatus provided with the power source part containing the low voltage battery and the DC-DC converter circuit, and with the flashing part containing the main capacitor, the said two parts being separable each other, and with means to stop compulsorily the operation of the power source part when the flashing part is separated from the power source part.

BRIEF EXPLANATION OF THE DRAWING

FIG. 1(*b*) is another perspective view of the said power source part A embodying the present invention.

FIG. 1(*c*) is a perspective view of the flashing part B embodying the present invention.

DESCRIPTION OF THE PREFERRED EMBODIMENTS

A strobo apparatus in accordance with the present invention comprises:

a power source part containing a low voltage battery and a DC-DC converter circuit, a flashing part containing main capacitor and a flash discharge tube, and being separably connected with said power source part, a detecting means for detecting a state of connection from said power source part to said flashing part and a state of supplying of voltage to said DC-DC converter circuit from said low voltage battery, and control means for controlling to disable said DC-DC converter circuit upon receipt of the output signal of said detecting means, when said flashing part and said power source part are separated each other, said power source part being provided with a first connecting terminal connected from a high potential terminal of said DC-DC converter circuit and a second connecting terminal connected from a low potential terminal of said low voltage battery through a power source switch, said flashing part being provided with a third and a fourth connecting terminals connected from respective two terminals of said main capacitor and also to said first and second connecting terminals, respectively.

Figure 1A:
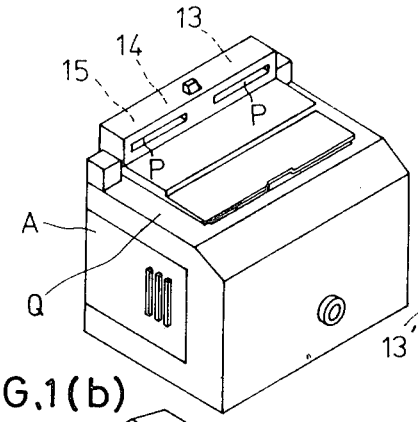
FIG. 1(*a*) is a perspective view of a power source part A embodying the present invention.
Figure 1C:
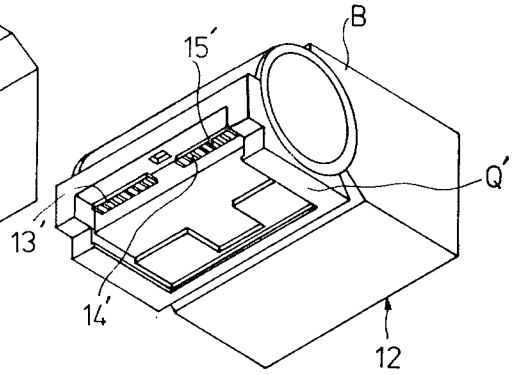
Figure 1B:
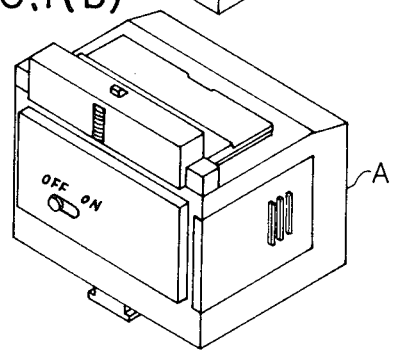
Figure 2:
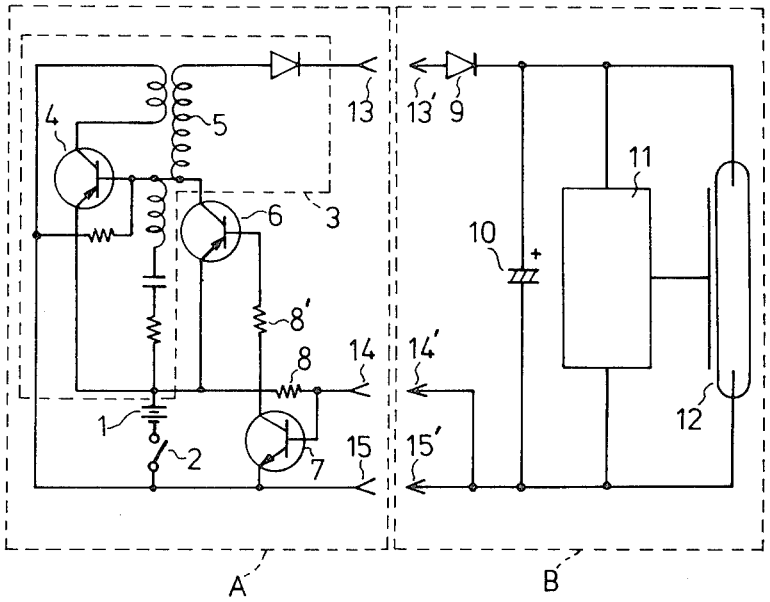
FIG. 2 is a circuit diagram of a strobo apparatus embodying the present invention.

The present invention is elucidated hereafter in reference to the drawings wherein FIG. 1(*a*) to (*c*) are perspective views of the part of strobo apparatus embodying the present invention, and FIG. 2 is an electric circuit diagram of the strobo apparatus embodying the present invention.

In FIG. 2, the power source part A is shown as surrounded by a broken line and the flashing part B is shown as surrounded by a broken line. As shown in FIG. 2, the low voltage battery 1 is connected through the power source switch 2 with the known DC-DC converter circuit 3 which comprises an oscillation transistor 4 and a transformer 5 and related components. The first switching transistor 6 is connected by the collector and the emitter to the base and the emitter of the oscillation transistor 4, respectively, and changes the oscillation transistor 4 to the nonconductivity state when the first switching transistor 6 is in the conduction. The second switching transistor 7 is connected by the collector to the base of the first switching transistor 6 through a resistance 8' and controls the operation of the first switching transistor 6. The base of the second switching transistor 7 is connected to the low voltage battery 1 through a resistance 8. The trigger circuit 11 of the flashing part B is connected in parallel with the main capacitor 10. The main capacitor 10 is connected in parallel with the flash discharge tube 12 which is triggered by the trigger circuit 11. A diode 9 is connected between the high potential terminal of the capacitor 10 and the connecting terminal 13'. The connecting terminals 13, 14 and 15 of the power source part A is separably connected with the connecting terminals 13', 14' and 15' of the flashing part B.

FIG. 1(*a*) is a perspective view of the power source part A embodying the present invention, and FIG. 1(*b*) is another perspective view of the said power source part A. FIG. 1(*c*) is a perspective view of the flashing part B embodying the present invention. For combining the power source part A and the flashing Part B of FIG. 1(*a*) and FIG. 1(*c*), the connecting terminals 13', 14' and 15' of the flashing part B is connected to the connecting terminals 13, 14 and 15 of the power source part A, by inserting into slots P which are formed on the power source part A wherein the connecting terminals 13, 14 and 15 are disposed. A contact plane Q' of the flashing part B is placed on a contact plane Q of the power source part A.

Concerning the operation of the above-mentioned strobo apparatus, first we describe the operation of the case when the power source part A and the flashing part B are combined by connecting the connecting terminals 13, 14 and 15 with the terminals 13', 14' and 15'.

In this case, as is obvious from FIG. 2, the base and the emitter of the second switching transistor 7 are short-circuited through the connecting terminals 14, 14', 15, 15', and accordingly, the second switching transistor 7 is maintained in the nonconductivity state. Therefore naturally the first switching transistor 6 becomes and is maintained in the nonconductivity state. And when the power source switch 2 is closed, the DC-DC converter circuit 3 containing the oscillation transistor 4 etc. starts to operate, and the main capacitor 10 begins to be charged. When the charging of the main capacitor 10 is accomplished, the trigger circuit 11 is ready for work, and upon a closing of a flash contact or the like switch, the flashing discharge tube 12 emits light consuming the energy charged in the main capacitor 10.

Next, we describe the operation of the case when the power source part A and the flashing part B are separated in such a situation the power source switch 2 is closed.

On this case, the base and the emitter of the second switching transistor 7, which has been short-circuited by the connecting terminals 14, 14', 15, 15', become intercepted.

Therefore, the base-current is supplied to the base of the second switching transistor 7 through the resistance 8 and the power source switch 2 from the low voltage battery 1. And the second switching transistor 7 becomes to conduction state, and the base current is supplied to the base of the first switching transistor 6 through the second switching transistor 7, the resistance 8' and the power source switch 2 from the low voltage battery 1, then the first switching transistor 6 becomes in conduction.

Accordingly, the base and emitter of the oscillation transistor 4 in the DC-DC converter circuit 3 is short-circuited by the first switching transistor 6, and the operation of the DC-DC converter circuit 3 is stopped compulsorily, although the voltage is supplied to the DC-DC converter circuit 3 from the low voltage battery 1.

That is, the energy amount of the battery 1 consumed in the power source part A is of a small energy which is necessary only to keep the first and second switching transistor 6, 7 in conduction. Therefore, although the power source switch 2 is closed when the flashing part B is separated from the power source part A, DC-DC converter circuit 3 does not consume much energy like the prior art, and the waste of energy of the battery 1 can be prevented.

Also, when the flashing part B is separated from the power source part A, the operation of the DC-DC converter circuit 3 stops, namely, the operation of the DC-DC converter circuit 3 stops when no load is connected to the DC-DC converter circuit 3, accordingly no high tension voltage is impressed on the oscillation transistor 4. Therefore, the versatility of the design of the oscillation transistor 4 is large. In addition, since unnecessary high tension voltage is not generated in the power source part A, the insulation between the connecting terminals 13 and 15 in the power source part A is more easy than the conventional art, where insulation between the connecting terminals is difficult because high voltage is always impressed across them. Therefore, the versatility of the design of the insulation becomes easier than the prior art. Since only a low voltage appears across the connecting terminals 14 and 15, the insulation thereacross is easy and sure, accordingly, by making the insulation across them very sure, danger of accidental generation of a high voltage across the terminals 13 and 15 can be eliminated.

Furthermore, when the power source part A is separated from the flashing part B, although the main capacitor 10 has been charged enough, of course the voltage of the main capacitor 10 does not appear across the connecting terminals 13' and 14' or across the connecting terminals 13' and 15' for the presence of the diode 9.

As above-mentioned, the present invention offers such strobo apparatus which has the power source part containing the low voltage battery, the DC-DC converter circuit etc. and the flashing part containing the main capacitor, the flashing discharge tube etc., the two said parts being separably connected each other, and has the control means which compulsorily stops the operation of the power source part when the said two parts are separated each other. Therefore, the strobo apparatus of the present invention can prevent the waste of the battery and give the large versatility of the design of the insulating treatment, etc. Accordingly, the present invention is very useful.

What is claimed is:

1. A strobo apparatus comprising:

a power source part containing a low voltage battery and a DC-DC converter circuit, a flashing part containing main capacitor and a flash discharge tube, said power source part being provided with a first connecting terminal connected from a high potential terminal of said DC-DC converter circuit and a second connecting terminal connected from a low potential terminal of said low voltage battery through a power source switch, said flashing part being provided with a third and a fourth connecting terminals connected from respective two terminals of said main capacitor and also to said first and second connecting terminals respectively, and being separably connected with said power source part, a detecting means for detecting a state of connection from said power source part to said flashing part and a state of supplying of voltage to said DC-DC converter circuit from said low voltage battery, and control means for controlling to disable said DC-DC converter circuit upon receipt of the output signal of said detecting means, when said power source part and said flashing part are separated each other.

2. A strobo apparatus in accordance with claim 1, wherein said detecting means is provided with the fifth connecting terminal which is taken out from a high potential terminal of said low voltage battery through a resistance, and provided with a sixth connecting terminal which is taken out from a low potential terminal of said main capacitor and which is connected to said fifth connecting terminal, and provided with a first switching element whose first main terminal is connected to said control means and whose first control terminal is connected to said fifth connecting terminal and is connected to said low voltage battery through said resistance, a supplying energy to said first control terminal is performed only when said power source part and said flashing part are separated and at the same time said power source switch is closed.

3. A strobo apparatus in accordance with claim 1, wherein said control means is provided with a second switching element whose second main terminal is connected between a base and an emitter of an oscillation transistor of said DC-DC converter, and whose second control terminal is connected to said detecting means.

* * * * *